United States Patent [19]

Craver

[11] Patent Number: 4,672,946

[45] Date of Patent: Jun. 16, 1987

[54] SECONDARY COMBUSTION DEVICE FOR WOODBURNING STOVE

[75] Inventor: Richard D. Craver, Orrville, Ohio

[73] Assignee: Orrville Products, Inc., Orrville, Ohio

[21] Appl. No.: 859,336

[22] Filed: May 5, 1986

[51] Int. Cl.[4] ..... F24C 1/14

[52] U.S. Cl. ..... 126/77; 126/83; 126/112

[58] Field of Search ..... 126/77, 83, 112; 110/210, 211, 214

[56] References Cited

U.S. PATENT DOCUMENTS

| | | | |
|---|---|---|---|
| 1,523,508 | 1/1925 | Bibb | 126/112 X |
| 1,596,922 | 8/1926 | Clevenger et al. | 126/112 X |
| 1,714,649 | 5/1929 | Walouke | 126/112 |
| 2,646,758 | 7/1953 | Greemen | 110/211 |
| 2,781,039 | 2/1957 | Kaiser et al. | 126/77 X |
| 3,610,179 | 10/1971 | Shaw | 110/214 |
| 4,111,181 | 9/1978 | Canney | 126/77 |
| 4,228,783 | 10/1980 | Kalenian | 126/112 |
| 4,232,650 | 11/1980 | Frank | 126/77 |
| 4,316,444 | 2/1982 | Gullickson | 126/77 |
| 4,330,503 | 5/1982 | Allaire et al. | 110/214 X |
| 4,343,288 | 8/1982 | Jjosvold | 126/112 |
| 4,611,572 | 9/1986 | Martenson | 126/77 |

*Primary Examiner*—Margaret A. Focarino

*Attorney, Agent, or Firm*—Body, Vickers & Daniels

[57] ABSTRACT

An improvement in a woodburning stove of the type including an exhaust flue opening; a combustion chamber for primary combustion, having an access door, a support for wood to be burned and a primary air inlet means for supplying primary air to support primary combustion of the wood to produce flue gases containing combustible particulate material; conduit means for directing the flue gases from the combustion chamber to the flue opening in a preselected path; and, secondary combustion means for burning the particulate material in the flue gases before the flue gases pass through the exhaust flue opening. The improvement involves the secondary combustion means for supplying many jets of secondary air into the flue gases adjacent to the combustion chamber together with a laterally elongated, secondary combustion device having a constriction effect on the flue gases and a large volume secondary combustion plenum chamber with the combustion device and plenum chamber connected in series between the combustion chamber and the exhaust flue opening. This secondary combustion device includes two closely spaced, generally parallel walls through which the flue gases and secondary air pass from the combustion chamber through an exit end of the device into the plenum chamber in a wide, narrow flow pattern and including means for thermally insulating the outermost wall of the secondary combustion device whereby it rapidly attains and retains a high temperature without absorbing substantial heat energy.

54 Claims, 9 Drawing Figures

SECONDARY COMBUSTION DEVICE FOR WOODBURNING STOVE

The present invention relates to an improved woodburning stove, such as a free-standing stove or fireplace insert, and more particularly to an improved secondary combustion device for such a woodburning stove.

BACKGROUND OF INVENTION

The invention is particularly applicable for use in a fireplace insert of the type now commonly sold for use in an existing fireplace, and it will be described with particular reference thereto; however, the invention has brought applications and may be used in free-standing woodburning stoves of which there are many examples. Such stoves are shown in Gullickson U.S. Pat. Nos. 4,316,444 and Frank 4,232,650.

In recent years, there has been a tremendous growth in the popularity of woodburning stoves, either of free-standing type or of the type located within a fireplace as a replacement for the inefficient fireplace normally provided in domestic dwellings. In view of this significant usage of such woodburning appliances, manufacturers have been attempting to increase the efficiency so that the energy produced by the burning wood is available for heating a room in which the appliance is located. In the past, domestic fireplaces were highly inefficient and most heat energy passed upward through the chimney. To increase the efficiency, the firebox or combustion chamber was enclosed and room air was circulated around bonnets or other heating surfaces within the stove to use the heat from the burning wood for increasing the temperature of the air circulating through the woodburning device. In this manner, the energy from the woodburning within the firebox was transmitted to the circulated room air for the purpose of increasing the efficiency of standard fireplaces. Even with these air circulating units, the burning efficiency of the wood itself was relatively low and a substantial amount of burnable or combustible particulate material passed upwardly, from the combustion chamber through the exhaust flue opening by normal draft. Consequently, the overall efficiency involving the total energy available in the wood was contingent upon this efficiency of burning within the firebox and the efficiency of transferring the heat from the firebox into the room. Heating efficiency can be increased by faster and hotter burning of the wood; however, this produces excessive heat which is not needed in the room during a relatively short time necessary to consume the fast burning wood. For that reason, woodburning stoves and fireplaces are usually throttled down at the primary air inlet to burn the wood fairly slowly. When this occurs, the burning efficiency drops and substantial particulate material passes up through the flue and into the atmosphere. Such reduced efficiency is an economic disadvantage in that the stove or insert consumes more wood. As a secondary consideration, slow burning of the wood substantially pollutes the atmosphere. Federal and State agencies are now promulgating regulations which require low pollution levels for fireplace inserts and stoves of the woodburning type. In 1988, the State of Oregon will require that such devices have an exhaust containing no more than 9.0 gr/hr particulate material as a weighted average. Other states are considering similar requirements for woodburning stoves and fireplace inserts.

Rigid State and impending Federal regulations will make it imperative that a woodburning stove or fireplace insert have a weighted average particulate value of less than about 9.0 gr/hr, such as is now the 1988 standard in the State of Oregon. Since manufacturers of fireplace inserts cannot guarantee where there units will be used or sold and do not want to exclude sales in any region of the country, there is a tremendous effort in the woodburning fireplace insert and stove industry to develop units which can pass or be certified in all states, including a state having a particulate maximum of about 9.0 gr/hr. The most convenient approach by manufacturers is to employ a catalytic converter, as shown in Allier U.S. Pat. No. 4,330,503. Many manufacturers are retrofitting or redesigning their standard stove or fireplace inserts to employ one of these converters. This approach is convenient, but expensive. Indeed, converters do not accomplish the real intent of the State and Federal regulations. A fireplace, stove or insert having a separate catalytic converter must have a flue gas bypass, so that the fire in the firebox reaches a certain temperature before the flue gases are passed through the catalytic converter. There is no assurance that a user of the insert will operate the bypass or will even understand its operation. In addition, if the bypass is not operated, the catalytic converter can become damaged or clogged and in such condition, the converter will not function to reduce particulate material. If the user burns toxic material containing certain minerals, the catalytic converter is immediately destroyed or its effect diminished. As can be seen, many things can occur which will make the catalytic converter inoperative for the purposes of controlling air pollution. The catalytic converter is quite expensive and available from a very limited number of sources; therefore, when it becomes inoperative, a user of the fireplace insert can remove the catalytic converter or continue to use the inoperative converter. All of these faults with converters make the use of a catalytic converter counterproductive for the purposes of reducing air pollution. Claims by manufacturers regarding transfer and burning efficiencies are diminished as converters become ineffective. Thus, although converters are convenient and are available to manufacturers wanting to avoid impending decertification, these catalytic converters are not necessarily the total answer to the problem of high efficiency and/or reduced air pollution.

Assuming that a manufacturer has decided not to incur the expense of a catalytic converter, either as original equipment or retrofit onto his present design, its inserts or woodburning stoves must be redesigned to meet the new standards which standards are determined by testing the particulate material issuing from the unit through at least four separate burning ranges controlled by the amount of primary air available to the firebox. These ranges are less than 10,000 BTU/hr; 10,000–15,000 BTU/hr; 15,000–20,000 BTU/hr; and over 20,000 BTU/hr. These tests are costly and are conducted for certification by approved testing organizations.

Since most domestic fires are at low burning rates, the most critical and heaviest weighted range is 10,000 BTU/hr or less. Manufacturers not opting for catalytic converters or catalytic converter rectofits have not been able to meet the 9.0 gr/hr 1988 Standard for Oregon; therefore, to be certified, the stoves or inserts have been modified to limit the inlet for primary air to a minimum amount causing rates at least substantially over 10,000 BTU/hr. In other words, since the problem most manufacturers face is heavy particulate at extremely low burning rates, their units must have a preselected minimum air getting to pass the impending air pollution standards. This concept of assuring only rapid burning of the wood to limit particulate exhaust is illusary. Such fireplace inserts or stoves sold to customers will burn too hot for normal domestic use. Consequently, these hot burning stoves and inserts create dissatisfied consumers and motivate users to block off the incoming primary air by separate devices like tape or by modifying the original equipment to allow greater reduction in the primary air. Thus, fireplace inserts presumably meeting certain air pollution standards, due to manufacturered minimum air capabilities, often are modified to burn at the lower air rates. This produces inefficiency and air pollution.

In view of this totally chaotic situation in reducing air pollution by fireplace inserts, there is a substantial need and desire among the manufacturers of stoves and fireplace inserts to develop a clean burning, high efficient unit which can be manufactured at a competitive price and does not involve a catalytic converter.

SUMMARY OF THE INVENTION

The present invention relates to an improved secondary combustion device for woodburning stoves, which includes both free-standing stoves and fireplace inserts. The improvement overcomes the disadvantages of prior attempts to produce a high efficiency, low pollution stove operable at combustion rates in the low range, such as near or below 10,000 BTU/hr. Burning of wood causes flue gases which contain particulate material that is combustible at high temperatures and is carried through the flue of the stove up the chimney.

Primary combustion of the wood is controlled by primary air being drawn into the combustion chamber or firebox by convection, usually from an adjustable air inlet. As the air inlet is closed, the burning rate of the primary combustion decreases, leaving a large amount of ladened particulate material in the flue gases. To burn the particulate material, it is common practice to provide secondary air drawn into the combustion chamber and distributed in some fashion adjacent the upper portion of the chamber, as shown in Gullickson U.S. Pat. No. 4,316,444, wherein a plenum chamber draws secondary air which is expelled in spaced jets through a plurality of laterally facing openings located above the woodburning area in the firebox or combustion chamber. A more common arrangement for providing secondary combustion to burn products of combustion in the flue gases is shown in Frank U.S. Pat. No. 4,232,650, wherein two plates 60,62 define a laterally extending nozzle for secondary air which is forced into the path of the flue gases prior to the gases entering the upper plenum area on their way to flue outlet 42. Although secondary air is available for burning of the products of combustion, little burning takes place since the surfaces above plate 60 in Frank U.S. Pat. No. 4,232,650 are metal heat sinks drawing heat energy from the products of combustion and, thus diminishing the secondary burning effect of the secondary air and combustible flue gases. Other arrangements for providing secondary combustion through introduction of secondary air in jets, or otherwise, above the firebox are shown in Bibb U.S. Pat. Nos. 1,523,508; Clevinger 1,596,922; and Walouke 1,714,649. All these prior patents are incorporated by reference herein to illustrate the concept of utilizing secondary air in the path between the firebox and exhaust flue outlet for the purposes of burning particulate material in the flue gases issuing from and created by primary combustion in the firebox or combustion chamber. The present invention relates to an improvement of such stoves wherein secondary combustion is maximized to increase efficiency and decrease pollution to the extent that the fireplace insert or stove can pass stringent pollution tests at low burning rates with inexpensive structural features, not involving catalytic converters requiring periodic replacement.

In accordance with the present invention, the improvement involves the secondary combustion arrangement of a stove having a plurality of distinct jets of secondary air directed into the flue gases adjacent to combustion chamber. A laterally elongated secondary combustion device is provided with a structure to cause a constriction effect on the flue gases and a large volume secondary combustion plenum chamber with the secondary combustion plenum chamber being connected in series between the primary combustion chamber and the exhaust flue opening. This secondary combustion device, in accordance with the invention, includes two closely spaced, generally parallel walls through which the flue gases and secondary air passes from the combustion chamber through an exit end of the device into the plenum chamber in a wide, narrow flow pattern and means for thermally insulating the outermost of the two parallel walls. This heat isolated outer wall can be heated rapidly and retains a high temperature without absorbing substantial heat energy. In this fashion, the outer wall does not constitute a heat sink through which energy can be absorbed for the purposes of decreasing the amount of heat energy necessary for burning the particulate material with the previously introduced secondary air. Jets of secondary air disrupt the flow of hot flue gases coming from the combustion chamber to cause further secondary combustion. This secondary combustion continues as the flue gases and secondary air pass through the relatively wide, narrow opening of the secondary combustion device. The wide, narrow opening has an upper stainless steel wall, which is not a heat sink. When this upper wall reaches a high temperature it remains at that temperature without absorbing appreciable amounts of heat energy. The mixture of secondary air and combustible flue gases pass through the long, narrow opening into the secondary combustion chamber, which is made of stainless steel and is also maintained at a high temperature above about 1200° F. These mechanically induced actions cause increased temperature, time and turbulence at the inlet and outlet ends of the elongated opening in the secondary combustion device. To increase further the turbulence and time at the outlet of the secondary combustion device, there is provided a turbulence creating means for causing turbulence of the mixture of gases and secondary air flowing from the exit end of the new device. This turbulence causing means includes a sheet metal baffle plate, angled downwardly into the flow pattern of the flue gases and air coming from the exit end of the secondary combustion device. Openings in this baffle allow flow of at least some of the gases and air in separate streams through the baffle plate and into the previously mentioned plenum chamber. By providing this baffle plate at the exit end of the wide, narrow secondary combustion chamber or device, perforations or openings in the baffle cause substantial turbulence and increased resident time. This increases the amount of combustible particles burnt during secondary combustion. In addition, the secondary combustion plenum chamber has a bottom floor below the elongated opening or outlet of the secondary combustion device so that this mixture of the flue gases and secondary air issuing from the secondary combustion chamber or device moves into the large volume plenum chamber in a downwardly deflected direction so that the mixture contacts the floor of the plenum chamber and then flows outwardly over this floor toward the exhaust opening at the opposite end of the plenum chamber from the secondary combustion device.

In accordance with another aspect of the invention, the lower floor of the plenum chamber is covered by a ceramic fiberous high insulation material having low heat conductivity, such as ceramic fiber sold under the the trademark "FIBER FAX". This fiber has filaments of inert ceramic extending upwardly from the outer surface of the thin layer used in the plenum chamber. Flue gases and secondary air issuing from the relatively narrow opening in the secondary combustion device is deflected downwardly against the layer of insulation material on the lower floor of the plenum chamber and scrubs over the surface of this layer so that the individual filaments form a multitude of hot surfaces continuing burning of the combustible particles by the secondary air in the flue gases.

In accordance with another aspect of the invention, secondary air is provided by a laterally extending manifold having a number of openings spaced longitudinally along the manifold and facing the path of the flue gases as they move from the combustion chamber toward the exhaust flue outlet. Secondary air issuing from the openings create active jets of ambient air that interact with and cause turbulence in the flue gases at a plurality of distinct jet created areas. Flue gases and secondary air jets are, thus, intermixed prior to being introduced into the passageway above the manifold. This passageway is a secondary combustion chamber formed by upper and lower stainless steel plates that produce a hot relatively narrow, long passageway. Flue gases and intermixed secondary air flowing through this passageway are burnt further, thus, increasing the amount of heat released from the gases and reducing the pollution load of gases entering the exhaust outlet.

In accordance with yet another aspect of the invention, the secondary combustion device has a selected area across its elongated opening which produces the narrow, wide flow of gases to facilitate surface contact with a surface at high temperature (over 1200° F.) and thorough combustion of the particles in the flue gases. This area is less than the area of the flue and, preferably, approximately 50% of the area of the flue opening. The flue opening has a damper which is movable to change the amount of draft. This damper has a normal closed position of approximately 25% of the flue gas opening. Consequently, the secondary combustion device causes an decreased velocity of the gases through the wide, opening thereof so that hot gases flow at a reduced rate against hot surfaces and into the hot plenum chamber where eddy currents or turbulence occurs. This action increases the time, temperature and turbulence of the gas and secondary air at the inlet of the plenum chamber.

The upper wall above the area of secondary combustion before entry into the secondary combustion device, is covered by a thin layer of relatively high insulation material so that no heat sink is provided above the flow path of the flue gases as they are mixed with secondary air before these gases have gone through the secondary combustion chamber or device and have been turbulated and issued into the large volume plenum chamber. The insulation layer holds heat so it becomes hot rapidly and remains hot without drawing energy from the secondary combustion process.

All of these features have resulted in a wood burning stove, i.e., insert, which produces substantially less than 9.0 gr/hr of particulate material when burning below 10,000 BTU/hr. Indeed, particulate levels in the flue gases issuing from a device constructed in accordance with the invention was 2.76 gr/hr when burning at a rate of 9306 BTU/hr. At 14,447 BTU/hr, the particulate level was 8.4 gr/hr. At 19,749 BTU/hr, the particulate level was 9.2 gr/hr. Since the low burning rate, below 10,000 BTU/hr is the normal operating condition of a domestic woodburning stove, the 2.76 gr/hr was weighted more than the 9.2 gr/hr. The total result was a weighted average of 6.8 gr/hr when compared to the required standard 9.0 gr/hr. This value was reached by practicing the invention, as defined above, and as shown in the preferred embodiment. The unit did not involve a catalytic converter which does not produce a substantially cleaner flue gas at under 10,000 BTU/hr. In the tests mentioned above, a fourth test was conducted wherein the burning rate was 30,823 BTU/hr. At this burn rate, which is not a domestic burning rate, there was 22.3 gr/hr of particulate material in the flue gases; however, this was explained by too much air and too high an air velocity to allow adequate burning of the wood in the primary burning condition. Such high burning rates are negligible in the weighted average which, even including this test run, was 6.8 gr/hr weighted average for the preferred embodiment of the present invention, as illustrated in drawings and defined above.

The primary object of the present invention is a provision of an improved woodburning stove, i.e. freestanding or a fireplace insert, which woodburning stove can burn wood at a relative low temperature and at a low particulate level in the exhaust gases, without using a catalytic converter.

Another object of the present invention is a provision of an improved woodburning stove of the type defined above, which stove can be manufactured with standard techniques available to stove manufacturers and without an excessive increase in the manufacturing costs.

Another object of the present invention is an improvement of a woodburning stove as defined above, which woodburning stove can operate indefinitely without replacement parts and still maintain its low particulate level for pollution output to the environment.

Still a further object of the present invention is a provision of an improved woodburning stove, as defined above, which stove can operate at below 10,000 BTU/hr and produce an exhaust of less than 9.0 gr/hr.

Yet another object of the present invention is the provision of an improved stove, as defined above, which stove cannot be modified by the user to decrease its pollution controlling structure.

Another object of the invention is the provision of a woodburning stove, as defined above, which woodburning stove has the advantages discussed above and provision of the structures as defined in the claims.

These other objects of advantage have become apparent from the following description taken together with the drawing discussed below.

PREFERRED EMBODIMENT

Figure 1:
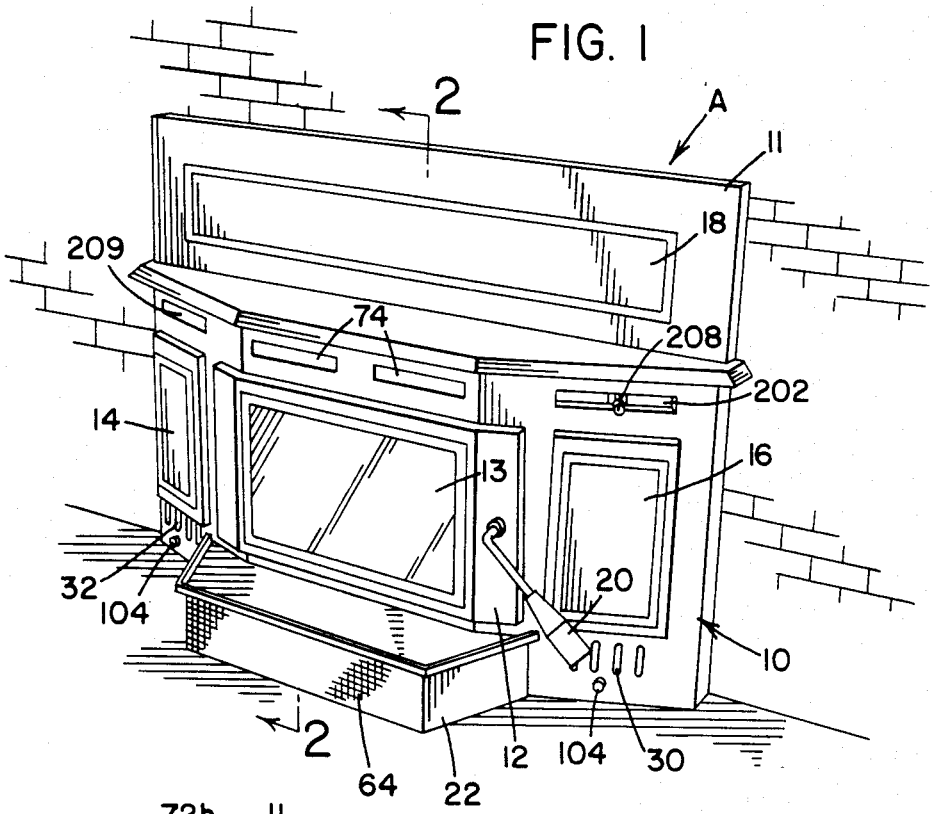
FIG. 1 is a pictorial view of the preferred embodiment showing a fireplace insert of the type using the present invention.
Figure 2:
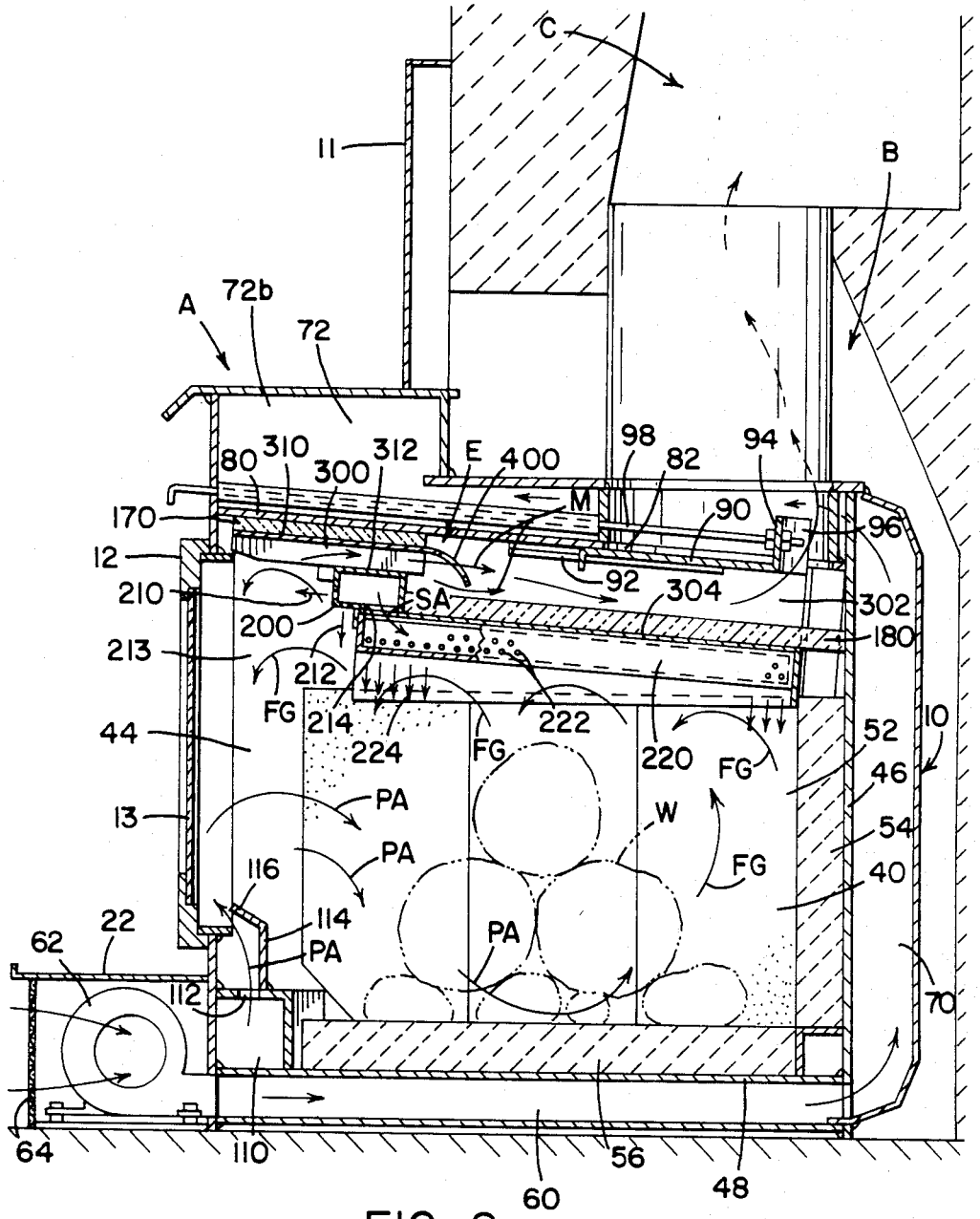
FIG. 2 is an enlarged, cross-sectional view taken generally along line 2—2 of FIG. 1.

Referring now to the drawings, wherein the showings are for the purpose of illustrating a preferred embodiment of the invention and not for the purpose of limiting same, FIG. 1 shows woodburning stove A, such as a fireplace insert, located in an existing fireplace cavity B having a chimney C as shown in FIG. 2. Insert A is a full face insert covering the total opening of fireplace B and includes a sheet metal housing 10 with an upstanding mantle 11 and a front access door 12 having a glass window 13. Trademark, decorative panels 14, 16, 18 are attached onto exposed walls of insert A in accordance with standard practice for inserts manufactured by assignee of this invention. These panels have no function, except as source designators for the fireplace insert and contribute to the total overall appearance or image of insert A. Door 12 has a handle 20 adapted to open and close the door for loading wood W into the insert, removing ashes and related manipulation within the insert. An outwardly extending fan housing 22 is used to circulate room air as will be explained later.

Primary air inlets 30, 32 are positioned on laterally opposite sides of insert A which includes an internal combustion chamber, or firebox, 40 defined by laterally spaced, diverging sidewalls 42, 44, a back wall 46 and a lower floor 48, all constructed of welded steel sheets. Layers of insulation materials, such as firebrick walls 50, 52, 54 and 56 are located on the inside of walls 42, 44 and 46 and over floor 48, respectively. Firebox 40 supports wood W on firebrick layer or wall 56; however, a grate could be used if desired.

Figure 5:
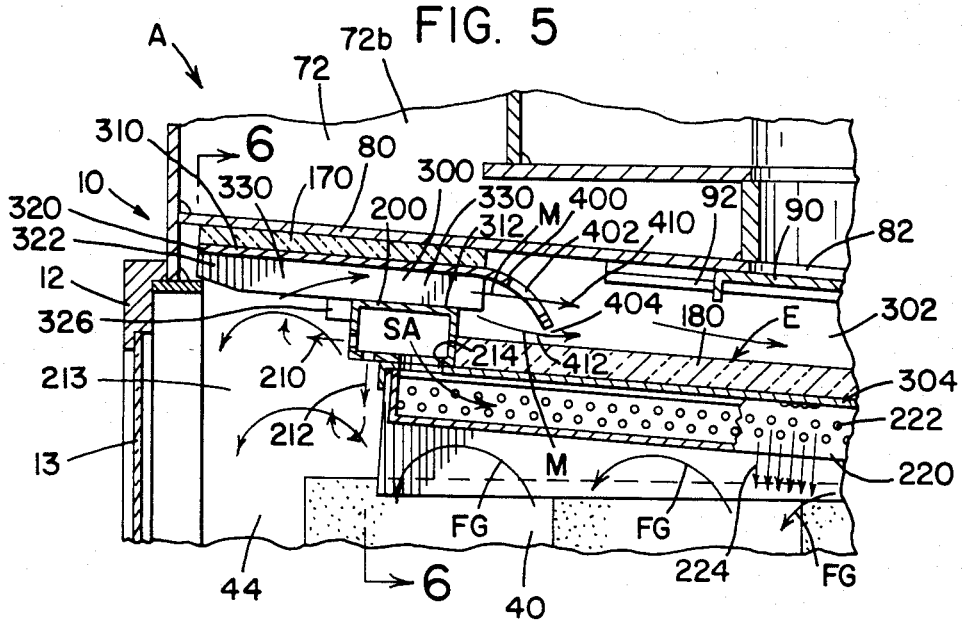
FIG. 5 is an enlarged, partial view showing the area of modification employed in the preferred embodiment of the invention.

Room air heated by insert A travels in a closed conduit system and does not comingle with the combustion products of wood W in firebox 40. The room air system has a wide, lower flat conduit 60, the upper wall of which is floor 48 of the firebox. Fan 62 draws room air through screen 64 and forces it under the firebox through flat conduit 60 to a vertical, rear conduit 70 having a width not substantially different than the width of conduit 60 and having a cross-sectional area at least as large as lower conduit 60. Air coming from conduit 60 is moved upwardly through conduit 70 and extracts transferred heat from floor 48 and then from backwall 46. The term "wide" means extending in a lateral direction with respect to housing 10 and in a direction perpendicular to the airflow, as clearly illustrated in the drawings. Above firebox or combustion chamber 40, is an upper bonnet 72 having diverging side walls 72*a*, 72*b* which directs room air from bonnet 72 through two forward facing outlets 74. Bonnet 72 has a lower wall 80 heated by secondary combustion and by the products of combustion from the firebox so that the room air absorbs the heat from the burning of wood W. The lower wall 80 is formed of steel plate and includes an exhaust flue opening 82 covered by a movable damper 90 riding along lateral rails 92, only one of which is shown in FIGS. 2 and 5. A minimum opening baffle 94 has rearwardly extending legs 96, only one of which is shown in FIG. 2, to allow damper 90 movement into a closed position only where a minimum flue opening of the damper of approximately 25% of flue opening 82 is maintained. Damper 90 is moved manually by an outward hand controlled slide bar 98, in accordance with somewhat standard practice.

Figure 3:
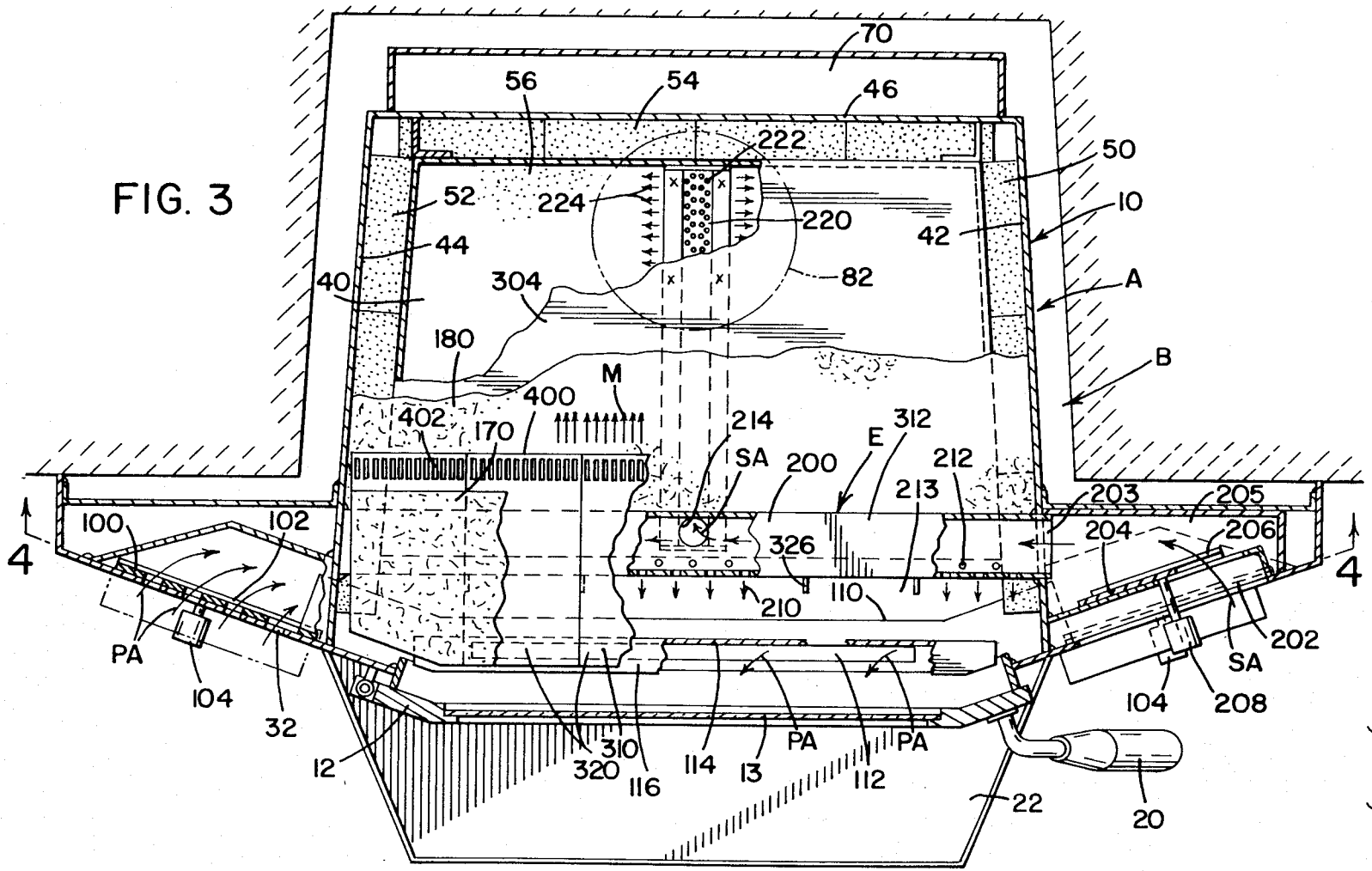
FIG. 3 is a cross-sectional view taken generally along line 3—3 of FIG. 4.
Figure 4:
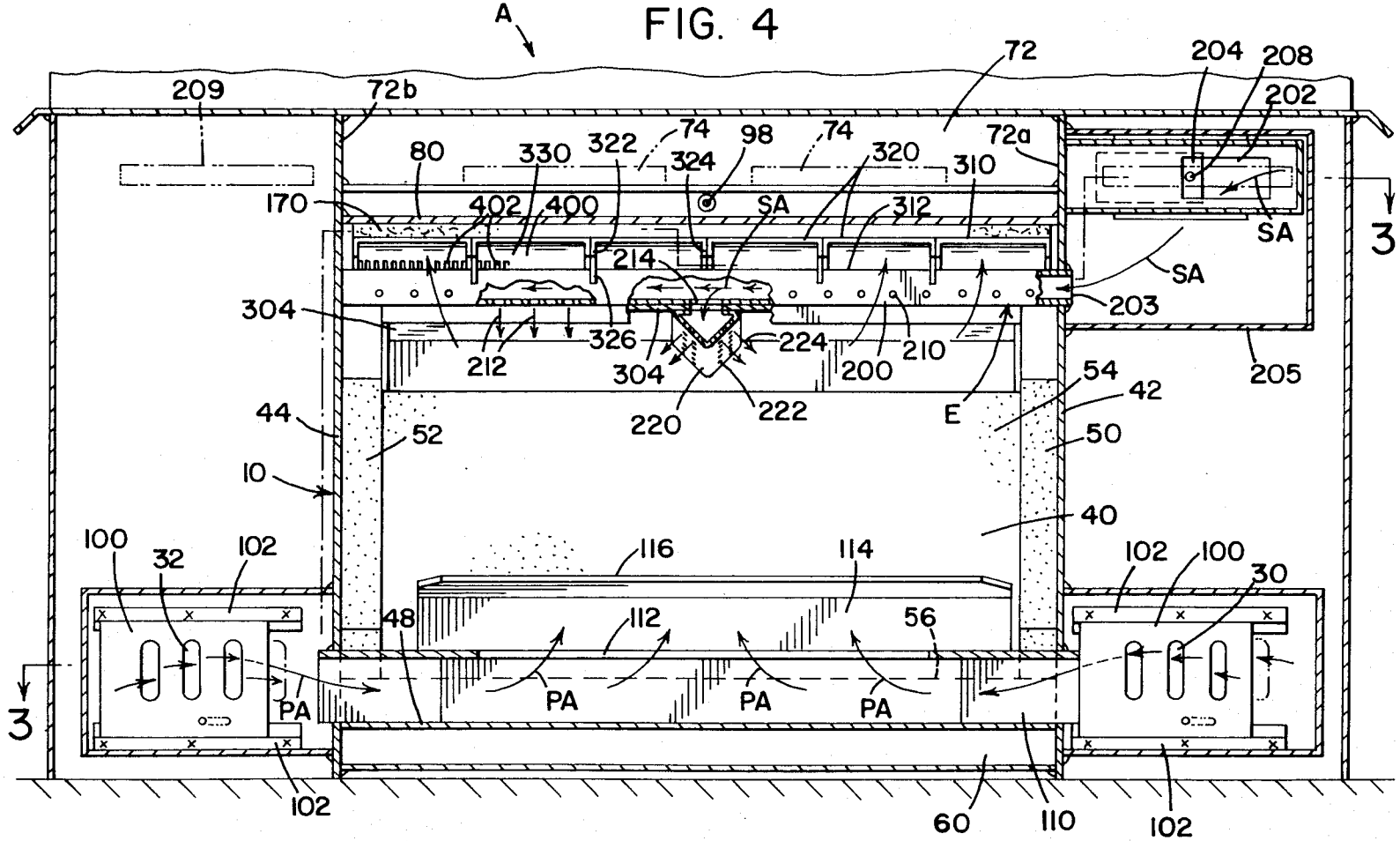
FIG. 4 is a cross-sectional view taken generally along line 4—4 of FIG. 3.

Referring now to the system for directing primary air into firebox 40 from inlets 30, 32, there are provided side plates 100 having openings corresponding generally to the openings on the lower front portion of insert A. Rails 102 allow reciprocation of plates 100 by outwardly directed handles 104 to control the amount of primary air entering the inlets 30, 32. A lower laterally extending, generally rectangular conduit 110 is positioned in the bottom of housing 10 just below window 13, as shown in FIGS. 2, 3 and 4. Primary air PA enters conduit 110 at a volumetric rate determined generally by the position of the side plates 100. An upper, elongated slot 112 having a length substantially the same as window 13 directs primary air PA upwardly toward the window and against window baffle 114, having an upward baffled nose 116 for directing primary air PA against window 13, as best shown in FIG. 2. The primary air then moves upwardly along the window for the purpose of cleaning the window and then enters firebox 40 to burn wood W, which burning creates a volume of flue gas represented by arrows FG issuing from the burning wood. The flue gases have particles which are still combustible and have not been fully burnt by the combustion process in firebox or chamber 40. As so far described, the operation of insert A is in accordance with the standard practice employed in many woodburning stoves.

Figure 9:
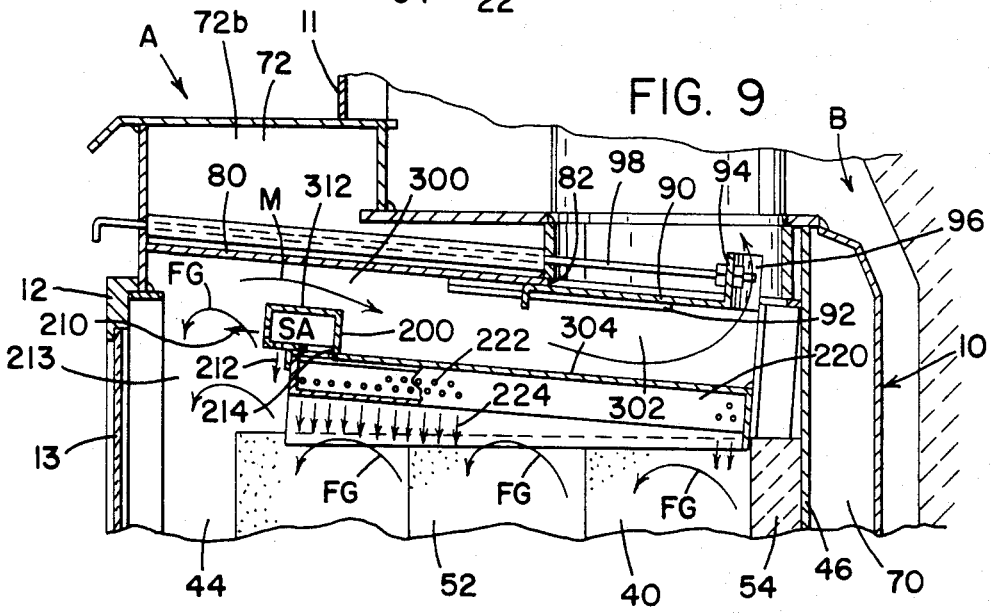
Figure 6:
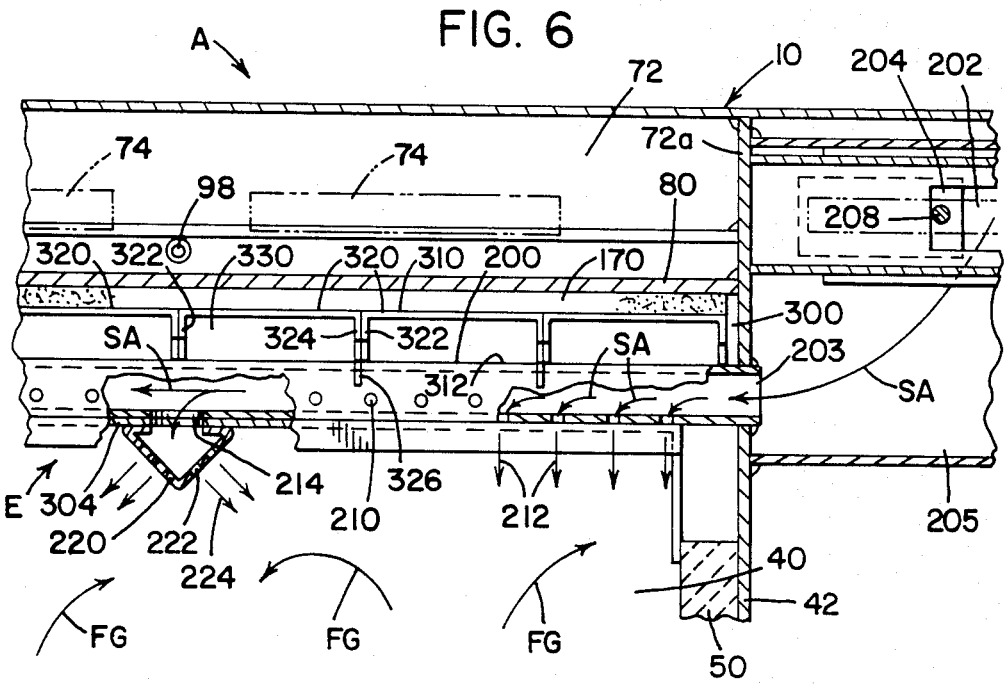
FIG. 6 is a partial front view taken generally along line 6—6 of FIG. 5.
Figure 7:
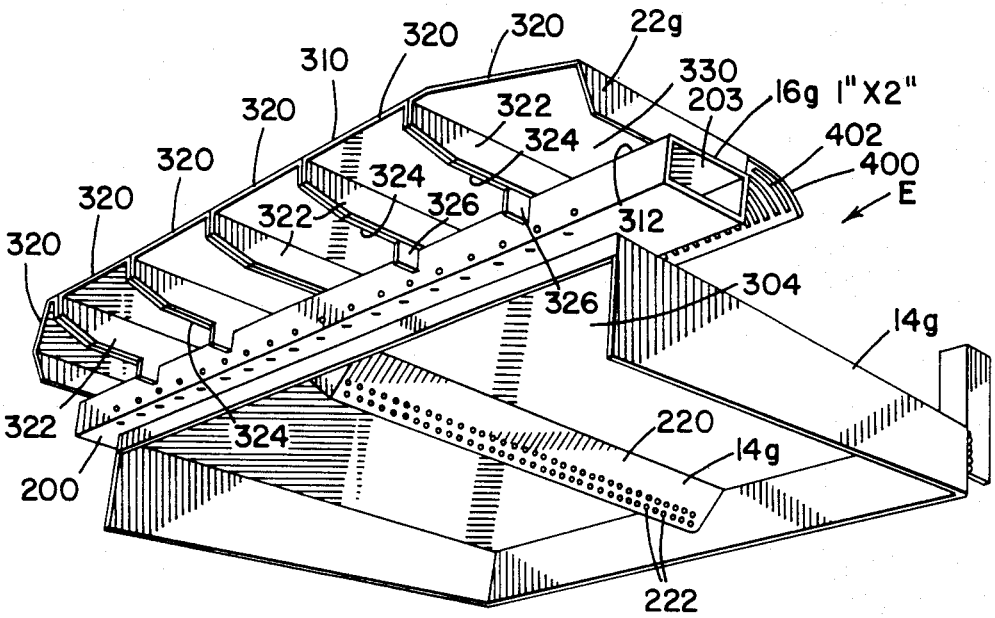
FIG. 7 is a pictorial view of the sheet metal device used in the preferred insert as illustrated in FIG. 1.
Figure 8:
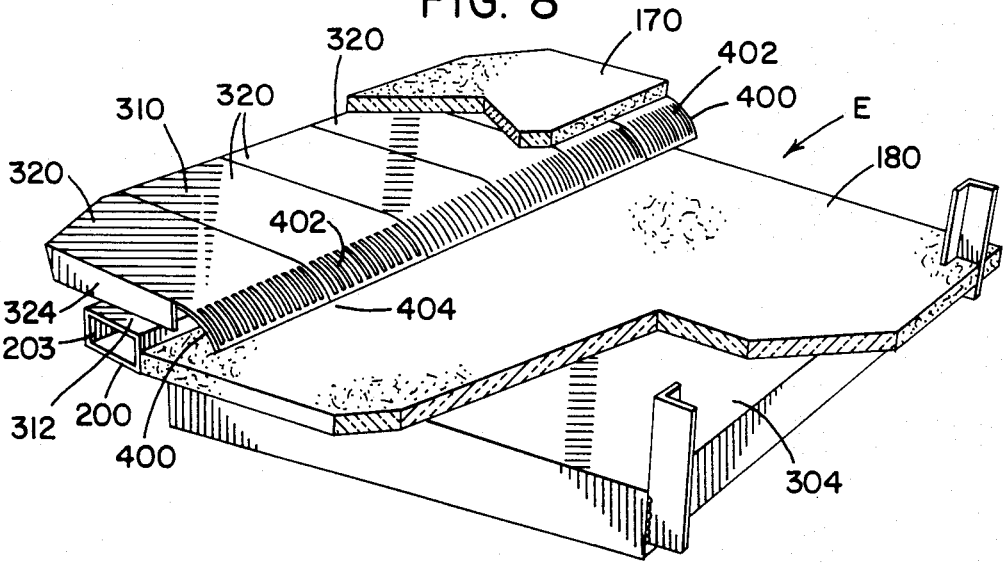
FIG. 8 is a pictorial view of the device, shown in FIG. 7 from a different position, showing thin layers of low thermal conductive, glass fiber material over certain sheet metal walls; and, FIG. 9 is a view similar to FIG. 5 showing a part of the preferred embodiment of the present invention and how it operates.

Insert A, in accordance with the invention, includes an improved secondary combustion device E, shown in the preferred embodiment, in FIGS. 7 and 8. The metal pieces shown in FIG. 7 are formed from stainless steel having the gage sizes indicated. Secondary combustion device E extends laterally across the top of firebox 40, as best shown in FIG. 2. Thin layers 170, 180 of highly efficient insulation material are employed, as shown in FIG. 8. Insulation material layers 170, 180 are $\frac{1}{4}''$ "FIBER FAX", which is a ceramic fiber material and is well known in the art. This insulation material provides an adequate heat barrier so that heat energy cannot pass through the barriers appreciably. The stainless steel sheet material is welded together, as shown in FIGS. 7 and 8 for use in insert A. This welded structure includes a secondary combustion, laterally extending air tube 200 formed from stainless steel tubing 1"×2". Referring now to FIGS. 4 and 6, laterally extending air tube 200 receives secondary air SA from an external inlet 202 through an opening 203 by way of chamber 205. Secondary air SA is drawn through inlet 202 and through a slide 204 riding in parallel rails 206. The amount of secondary air SA is controlled by manually adjusting slide 204 with handle 208. To balance the appearance of inlet 202 and room outlets 74, a dummy opening 209 is provided, as shown in FIG. 1. A first group of jets 210, having the number shown in the drawings and the distribution laterally along tube 200 as shown in drawings, are directed generaly orthogonally to the path of movement of flue gases FG from combustion chamber 40 to flue opening 82, as best shown in FIGS. 2 and 5. These secondary air jets cause turbulence or eddy currents in the flue gases as they pass upwardly around the front of air tube 200 to cause turbulence, agitation and comingling of secondary air SA with the hot products of combusion or flue gases FG. A second group of closely spaced air jets 212 are also provided in air tube 200. These jets point downwardly in a counterflow direction with the upcoming or upwardly moving flue gases. The combined counterflow movement and orthogonal outward jet action causes a secondary burning effect in secondary combustion area 213. An opening 214 communicates the interior of tube 200 with a second secondary air tube 220 extending from the front to the back portion of firebox 40 and above firebox 40. This second tube has been employed before and includes a plurality of openings 222 to produce angled jet 224 directing secondary air SA downwardly into the flue gases FG, as show in FIGS. 2, 5, and 6. When the device E is in place, there is provided an upper laterally elongated or wide, narrow passageway 300, shown in FIG. 9 without certain features of device E being employed. This narrow transversely or laterally extending passageway 300 communicates secondary combustion area 213 with a large volume plenum chamber 302, having a lower floor 304 constituting one element of device E, as shown in FIGS. 7 and 8. Lower floor 304 has upper insulation layer 180, as previously described. Operation of the device E, in accordance with the invention and as so far described, is illustrated in FIG. 9 wherein secondary air SA is directed downwardly into firebox 40 by jets 224 so that secondary combustion occurs adjacent tube 200 in accordance with somewhat standard technology. This mixture of secondary air and flue gases then passes through area 213 where orthogonal jets 210 and counterflow jets 212 agitate and cause turbulence in the upwardly moving flue gases and secondary air SA. This introduction of further secondary combustion air SA and further agitation in area 213 causes the secondary air and flue gases to comingle and form a burnable gas mixture M, which mixture passes through laterally extending, relatively narrow opening 300 into plenum chamber 302, and then above floor 304 and through damper 90. Stainless steel sheet is a conductor of heat; therefore, tube 200 preheats the incoming secondary air SA somewhat. This is not sufficient to lower the temperature of the upper wall of tube 200 below about 1200° F. Agitation of the flue gases above the firebox by jets 224, further agitation by jets 210, 212 and passage through a hot, wide, narrow opening 300 into a large volume hot plenum chamber causes more complete burning of the particles carried in the flue gases. This is an improvement over systems previously employed; however, the present invention anticipates still further burning of the product of combustion to render insert A capable of passing rigid standards requiring a maximum weighted average of no more than about 9.0 gr/hr of particulate material passing up the chimney.

In accordance with the present invention, the thin insulation layer 170 on wall 80 covers the top of secondary combustion area 213 and extends over passageway 300, as best shown in FIG. 5. In this way, the secondary combustion in area 213 is not exposed to a heat sink such as surface 80; therefore, area increases in temperature rapidly and heat is retained in the mixture M as it passes through slot or opening 300. The secondary combustion produces temperatures over 1200° F., which are not dependant on the burning temperatures in firebox 40. Primary temperatures may be lower. To hold insulation layer 170 in place, stainless steel wall 310 is provided in a generally parallel relationship above upper wall 312 of stainless steel tube 200. Wall 310 extends laterally and is formed from a series of abutting individual stainless steel channels 320 having edges or legs 322, 324 adapted to be supported on tube 200, as shown in FIG. 7, at a location determined by ears 326. Parallel walls 310, 312, define a hot secondary combustion chamber 330 in passageway 300 being relatively wide and extending over the girth or width of firebox 40. Chamber 330 is laterally extending and has an exit end producing a wide, narrow path of movement of mixture M as it flows through passage 300 by way of secondary combustion chamber 330. The chamber is bordered by stainless steel which is heat resistant and reflective to retain the hot temperatures over 1200° F.

The upper wall made up of channels 320 supports insulation layer 170 as shown in FIG. 8. As so far described, mixture M flows through chamber 330 and exits into plenum chamber 302 where it moves laterally across the top of thin insulation layer 180. This second insulation layer is made from ceramic fibers which are inert; however, they are heated by the hot mixture M and further secondary combustion in chamber 302 to an extremely hot temperature which further burns particulate material within mixture M before it passes through chimney C. The temperature in secondary combustion chamber 330 is in the neighborhood of 1200° F. to 1800° F. and the area of this passage is substantially less than the flue area. In practice, the area is approximately 50% of the flue area, which flue is a 6" diameter opening. Passageway 300 retards flow of mixture M which maintains the gases within the combustion chamber or firebox a small increased time, which may be in the neighborhood of several milliseconds. This increased residence time together with the agitation caused by the three separate secondary air jet systems or networks produces extremely efficient burning of the solid particles in flue gases FG before the gases even pass through combustion chamber 330 of device E.

Since stainless steel is used for device E, this material does not form a heat sink and the temperature within device E rises rapidly upon initial burning of wood W in the firebox.

Device E, as so far described, was tested against the Oregon 1988 Standards and was rated at 9.2 gr/hr. Further testing would have undoubtedly resulted in certifying of insert A with the secondary combustion device E, as so far described; however, in accordance with another aspect of the present invention, the channels 320 forming upper stainless steel wall 310 were extended to include an outwardly extending turbulence causing baffle 400 curved downwardly from the exit end of passage 330 and formed as a continuation of wall 310. This baffle is formed from separate channels 320.

The downwardly curved baffle includes a plurality of closely spaced slots 402 and defines a lower space 404, shown in FIG. 5, below the edge of the baffle and above the upper surface of insulation layer 180. In this manner, two separate flows occur as mixture M issues from chamber 330. The first flow 210 passes through elongated slots 402. The second flow, flow 412, passes under the edge of baffle 400. In practice, the area of slots 400 which extend from a tangential portion of the baffle to nearly the end thereof, is substantially the same as space 404, thus half of mixture M is forced downwardly to flow over the upper surface of layer 180 through elongated slot or space 404. The same amount of mixture M passes through the individual, closely spaced slots 402. This causes turbulence and increased residence time. The perforations, slots or other devices for causing turbulence as the mixture passes through the baffle are preferably elongated slots so that they will not become clogged.

As flow 412 passes over the upper surface layer 180, the hot ceramic fibers of the insulation material increase the efficiency of the burning action caused by the secondary air in the mixture M. Baffle 400 drives the gases down and away from the upper plate 80 in plenum chamber 302. This adds turbulence and increases the efficiency of the secondary burning operation. The action with insulation layer 180 is a thermal effect caused by turbulence as mixture M passes over the rough upper surface of layer 180. Also, insulation 180 is above firebox 40 and retains heat of primary and secondary combustion in the firebox for the purposes of assisting in better combustion in the firebox itself. By using the device E, insert A can be used to burn wood at a temperature substantially below 20,000 BTU/hr and still meet stringement Oregon 1988 Standards. Other inserts on the market, without catalytic converters, must burn above about 20,000 BTU/hr before the Standard can be met. This is substantially above the normal operation condition of a fireplace insert for domestic use.

By using the present invention, the temperature within the firebox itself can be in the neighborhood of 1,000° F. while the secondary burning starting at the top of the firebox and progressing into area 213 can be at substantially higher temperatures such as 1300° to 1400° F. Some prior art devices have attempted to use the primary burning itself to produce secondary combustion. To accomplish this, the walls had to be heated to a temperature greatly exceeding the necessary temperature for the primary burning. This does not occur in the present invention. By employing this invention, there is no need for heavy insulation since the high temperatures experienced in secondary burning are acting on low density materials such as flue gases and not on primary burning. Thus, relatively thin layers, in the neighborhood of $\frac{1}{4}''$, are made sufficient for layers 170, 180 by practicing the present invention wherein the reburning for secondary combustion occurs at a location spaced from the primary heating source. As can be seen, there is no need to heat firebricks to secondary burning temperatures in using secondary combustion device E. Thus, the only surfaces which must be brought up to sufficiently high temperature are the stainless steel portions facing area 213, chamber 330 and the lower part of plenum chamber 302. As can be seen, these surfaces, which must be elevated to a secondary burning temperature, are not heat sinks and can be raised in temperature quickly by exposure to secondary combustion. These advantages not only obtained the reduced pollution for which the device was developed, but does this at a low cost and at high efficiency.

Flue gases FG are first burnt near the rear of the fire box and are then remixed as once burnt gases with additional secondary air from jets 210, 212 for a subsequent reburning or secondary combustion starting in area 213 and continuing through device F, including plenum chamber 302. Exposed outer surface of layer 180 could be covered with a thin stainless steel sheet without changing the inventive concept. This sheet would become hot fast and would not present sufficient mass for a cooling heat sink.

Having thus defined the invention, the following is claimed:

1. In a wood burning stove including an exhaust flue opening, a combustion chamber for primary combustion having an access door, a support for wood to be burnt and a primary air inlet means for supplying air to support primary combustion of said wood to produce flue gases containing combustible particulate material, conduit means for directing said flue gases from said combustion chamber to said flue opening in a preselected path and secondary combustion means for burning said particulate material in said flue gases before said flue gases pass through said exhaust flue opening, the improvement comprising: said secondary combustion means including an elongated manifold extending laterally across and above said combustion chamber at a preselected position on said preselected path, a number of air openings spaced longitudinally along said manifold and facing said path of said flue gases and an air inlet means for supplying ambient, secondary combustion air to said manifold for flow from said openings into said path of said flue gases in a plurality of distinct jets, and a laterally elongated passageway above said manifold with upper and lower portions and defined at its upper portion by a sheet metal wall, and a layer of extremely low heat conducting insulation in said passageway and on said sheet metal wall whereby said layer of insulation prevents appreciable conduction of heat from said passageway into said sheet metal wall and said flue gases flow through said passageway and from said passageway in a generally wide thin flow pattern.

2. An improvement as defined in claim 1, wherein said longitudinal spaced air openings include two separate groups of openings with jets from said first group directed generally transverse to said path of said flue gases.

3. An improvement as defined in claim 2, wherein said manifold includes an upper generally flat wall, generally parallel to said sheet metal wall and defining the lower portion of said elongated passageway with said flue gases flowing through said passageway between said insulation layer in said passageway and said generally flat manifold wall.

4. The improvement as defined in claim 3, including a thin sheet of high temperature metal overlying said insulation layer in said passageway.

5. The improvement as defined in claim 4, including a flue gas plenum chamber between said passageway and said exhaust flue opening, said plenum chamber having a lower floor across said combustion chamber and a second layer of low heat conducting insulation over said floor whereby flue gases flowing from said elongated passageway in said wide flow pattern pass over said second layer of insulation over said floor.

6. The improvement as defined in claim 5, wherein said second layer of insulation includes ceramic, inert fibers extending from said layer into said plenum chamber.

7. The improvement as defined in claim 6, including an elongated diffuser means extending across the passageway for causing turbulent flow of said flue gases as they flow from said passageway.

8. The improvement as defined in claim 7, wherein said diffuser means includes a sheet metal baffle plate angled downwardly into said gases and defining a space for flow of said gases below said sheet metal baffle plate and said baffle plate having opening means for allowing flow of flue gases in separate streams from said passageway through said opening of said baffle plate.

9. The improvement as defined in claim 8, wherein said area of said space and the area of said openings in said baffle plate are approximately equal.

10. The improvement as defined in claim 9, wherein said elongated passageway has a first area and said exhaust flue opening has a second area and said second area is about twice said first area.

11. The improvement as defined in claim 10, including means for adjusting said second area.

12. An improvement as defined in claim 1, wherein said manifold includes an upper generally flat wall, generally parallel to said sheet metal wall and defining the lower portion of said elongated passageway with said flue gases flowing through said passageway between said insulation layer in said passageway and said generally flat manifold wall.

13. The improvement as defined in claim 1, including a thin sheet of high temperature metal overlying said insulation layer in said passageway.

14. The improvement as defined in claim 1, including a flue gas plenum chamber between said passageway and said exhaust flue opening, said plenum chamber having a lower floor across said combustion chamber and a second layer of low heat conducting insulation over said floor whereby flue gases flowing from said elongated passageway in said wide flow pattern pass over said second layer of insulation over said floor.

15. The improvement as defined in claim 14, wherein said second layer of insulation includes ceramic, inert fibers extending from said layer into said plenum chamber.

16. The improvement as defined in claim 3, including a flue gas plenum chamber between said passageway and said exhaust flue opening, said plenum chamber having a lower floor across said combustion chamber and a second layer of low heat conducting insulation over said floor whereby flue gases flowing from said elongated passageway in said wide flow pattern pass over said second layer of insulation over said floor.

17. The improvement as defined in claim 16, wherein said second layer of insulation includes ceramic, inert fibers extending from said layer into said plenum chamber.

18. The improvement as defined in claim 1, including an elongated diffuser means extending across the passageway for causing turbulent flow of said flue gases as they flow from said passageway.

19. The improvement as defined in claim 18, wherein said diffuser means includes a sheet metal baffle plate angled downwardly into said gases and defining a space for flow of said gases below said sheet metal baffle plate and said baffle plate having opening means for allowing flow of flue gases in separate streams from said passageway through said opening of said baffle plate.

20. The improvement as defined in claim 19, wherein said area of said space and the area of said openings in said baffle plate are approximately equal.

21. The improvement as defined in claim 1, wherein said elongated passageway has a first area and said exhaust flue opening has a second area and said second area is about twice said first opening.

22. The improvement as defined in claim 21, including means for adjusting said second area.

23. The improvement as defined in claim 1, including a flue gas plenum chamber between said passageway and said exhaust flue opening, said plenum chamber having a lower floor across said combustion chamber.

24. The improvement as defined in claim 23, including an elongated diffuser means extending across the passageway for causing turbulent flow of said flue gases as they flow from said passageway.

25. The improvement as defined in claim 24, wherein said diffuser means includes a sheet metal baffle plate angled downwardly into said gases and defining a space for flow of said gases below said sheet metal baffle plate and said baffle plate having opening means for allowing flow of flue gases in separate streams from said passageway through said opening of said baffle plate.

26. The improvement as defined in claim 25, wherein said area of said space and the area of said openings in said baffle plate are approximately equal.

27. The improvement as defined in claim 23, wherein said elongated passageway has a first area and said exhaust flue opening has a second area and said second area is about twice said first area.

28. The improvement as defined in claim 1, wherein said combustion chamber has an upper portion above said burning wood and including a second manifold extending in said combustion chamber across said upper portion of said chamber and means for directing jets of secondary air from said manifold into said upper portion of said combustion chamber.

29. The improvement as defined in claim 28, wherein said secondary air is provided from said laterally extending manifold.

30. In a wood burning stove including an exhaust flue opening, a combustion chamber for primary combustion having an access door, a support for wood to be burnt and a primary air inlet means for supplying air to support primary combustion of said wood to produce flue gases containing combustible particulate material, conduit means for directing said flue gases from said combustion chamber to said flue opening in a preselected path and secondary combustion means for burning said particulate material in said flue gases before said flue gases pass through said exhaust flue opening, the improvement comprising: said secondary combustion means including means for supplying many jets of secondary air into said flue gases adjacent said combustion chamber, a laterally elongated secondary combustion device having a constriction effect on said flue gases and a large volume secondary combustion plenum chamber with said combustion device and plenum chamber connected in series between said combustion chamber and said exhaust flue opening, said secondary combustion device including two closely spaced generally parallel walls through which said flue gases and secondary air pass from said combustion chamber through an exit end of said device to said plenum chamber in a wide, narrow flow pattern and means for thermally insulating the outermost of said wall whereby it retains a high temperature without absorbing substantial heat energy.

31. The improvement as defined in claim 30, including means on said combustion device for dividing said wide, narrow flow pattern into separate parallel flows of said flue gases and secondary air at least at said exit end of said device.

32. The improvement as defined in claim 31, including turbulence creating means at the exit end of said device for causing turbulence of said gases and air flowing from said exit end of said device.

33. The improvement as defined in claim 32, wherein said turbulence causing means includes a sheet metal baffle plate angled downwardly into said flow pattern coming from said exit end of said device and having opening means for allowing flow of at least some of said gases and air in separate streams from said device into said plenum chamber.

34. The improvement as defined in claim 33, wherein said baffle plate defines a space below said plate for flow of gases and air from said exit end around said baffle plate without passing through said opening means.

35. The improvement as defined in claim 34, wherein said opening means have a combined area and said space has an area with said combined area and said space area being approximately equal.

36. The improvement as defined in claim 30, including turbulence creating means at the exit end of said device for causing turbulence of said gases and air flowing from said exit end of said device.

37. The improvement as defined in claim 36, wherein said turbulence causing means includes a sheet metal baffle plate angled downwardly into said flow pattern coming from said exit end of said device and having opening means for allowing flow of at least some of said gases and air in separate streams from said device into said plenum chamber.

38. The improvement as defined in claim 37, wherein said baffle plate defines a space below said plate for flow of gases and air from said exit end around said baffle plate without passing through said opening means.

39. The improvement as defined in claim 30, wherein said secondary air supply means includes means for creating a first set of secondary air jets spaced transversely across said combustion chamber near said secondary combustion device and generally coextensive with said lateral elongation of said secondary combustion device.

40. The improvement as defined in claim 39, wherein said first set of jets extend into said preselected path.

41. The improvement as defined in claim 40, including means for creating a second set of jets coextensive with said first set of jets and extending in counter-flow direction with said preselected path.

42. The improvement as defined in claim 41, including a means for creating a set of secondary air jets extending across the combustion chamber and above said burning wood.

43. The improvement as defined in claim 39, including a means for creating a set of secondary air jets extending across the combustion chamber and above said burning wood.

44. The improvement as defined in claim 30, including a means for creating a set of secondary air jets extending across the combustion chamber and above said burning wood.

45. The improvement as defined in claim 30, wherein said plenum chamber includes a lower floor parallel to said two closely spaced walls and substantially below said exit end of said device and a roof above said exit end of said device whereby said gases and secondary air from said device resides in said plenum chamber.

46. The improvement as defined in claim 45, including a layer of low heat conductive insulating material on said lower floor.

47. The improvement as defined in claim 46, wherein said layer of insulation material includes ceramic, inert fibers extending from said layer into said plenum chamber.

48. The improvement as defined in claim 30, wherein thermally insulating means includes a layer of ceramic fiber insulation.

49. A secondary combustion device for a wood burning stove including an exhaust flue opening, a combustion chamber for primary combustion having an access door, a support for wood to be burnt and a primary air inlet means for supplying air to support primary combustion of said wood to produce flue gases containing combustible particulate material, conduit means for directing said flue gases from said combustion chamber to said flue opening in a preselected path and secondary combustion means for burning said particulate material in said flue gases before said flue gases pass through said exhaust flue opening, said secondary combustion device comprising: a set of secondary air jet means above said combustion chamber for introducing secondary air into said flue gases; a first secondary burning chamber having an upper exposed wall for burning said particulate material by said secondary air into an intermediate gas mixture; an insulation layer means on said exposed wall for preventing said wall from absorbing appreciable heat energy; a second secondary combustion chamber means defined by said wall and a lower generally parallel closely spaced wall for causing said intermediate gas mixture to move in a wide, narrow path to a chamber outlet; a plenum chamber means having a volume for holding said intermediate gas mixture after it passes from said chamber outlet and before it exits from said exhaust opening; and, means for causing turbulence in said plenum chamber and adjacent said chamber outlet.

50. The improvement as defined in claim 49, wherein said turbulence causing means includes a sheet metal baffle plate angled downwardly into said flow pattern coming from said exit end of said device and having opening means for allowing flow of at least some of said gases and air in separate streams from said device into said plenum chamber.

51. The improvement as defined in claim 50, wherein said baffle plate defines a space below said plate for flow of gases and air from said exit end around said baffle plate without passing through said opening means.

52. The improvement as defined in claim 49, wherein said plenum chamber includes a lower floor parallel to said two closely spaced walls and substantially below said chamber outlet and a roof above said chamber outlet whereby said gases and secondary air from said outlet resides in said plenum chamber.

53. The improvement as defined in claim 52, including a layer of low heat conductive insulating material on said lower floor.

54. The improvement as defined in claim 53, wherein said layer of insulation material includes ceramic, inert fibers extending from said layer into said plenum chamber.

* * * * *